US007024725B2

(12) United States Patent
Homberg

(10) Patent No.: US 7,024,725 B2
(45) Date of Patent: Apr. 11, 2006

(54) OVERHEAD DOOR CLOSER WITH SLIDE ARM ASSEMBLY

(75) Inventor: Jürgen Homberg, Hagen (DE)

(73) Assignee: Dorma GmbH + Co. KG, Ennepetal (DE)

( * ) Notice: Subject to any disclaimer, the term of this patent is extended or adjusted under 35 U.S.C. 154(b) by 0 days.

(21) Appl. No.: 10/467,986

(22) PCT Filed: Feb. 11, 2002

(86) PCT No.: PCT/EP02/01404

§ 371 (c)(1),
(2), (4) Date: Aug. 13, 2003

(87) PCT Pub. No.: WO02/064926

PCT Pub. Date: Aug. 22, 2002

(65) Prior Publication Data

US 2004/0074145 A1 Apr. 22, 2004

(30) Foreign Application Priority Data

Feb. 13, 2001 (DE) ..... 101 07 046

(51) Int. Cl.
*E05F 1/08* (2006.01)

(52) U.S. Cl. ..... 16/79; 16/58; 16/62; 16/64; 74/462; 74/464

(58) Field of Classification Search ..... 16/79, 16/58 X, 62 X, 69, 64, DIG. 10, 52; 74/462 X, 74/464 X
See application file for complete search history.

(56) References Cited

U.S. PATENT DOCUMENTS

| | | | | |
|---|---|---|---|---|
| 633,682 A | | 9/1899 | Cliff | |
| 1,359,144 A | | 11/1920 | Angell | |
| 2,829,395 A | * | 4/1958 | Schlage | 16/52 |
| 2,933,755 A | | 4/1960 | Carlson | |

(Continued)

FOREIGN PATENT DOCUMENTS

DE 41 24 282 A1 1/1993

(Continued)

OTHER PUBLICATIONS

Boston Gear, Gear Catalog, pp. 136-139.

(Continued)

*Primary Examiner*—Brian E. Glessner
*Assistant Examiner*—Mark Willaims
(74) *Attorney, Agent, or Firm*—Cohen, Pontani, Lieberman & Pavane

(57) ABSTRACT

This invention relates to an overhead door closer with slide arm assembly having a toothed pinion that is eccentrically supported and presents a circular rolling curve, which pinion meshes with a toothed rack arranged at a piston. The invention concentrates on a particular embodiment of the rolling curve and of the teeth of the toothed rack in adaptation to a toothing of the pinion. Furthermore, the invention concentrates on an improved embodiment of the delayed closing operation in order to achieve an optimized movement pattern of the piston within the housing of the overhead door closer with slide arm assembly.

29 Claims, 10 Drawing Sheets

U.S. PATENT DOCUMENTS

| | | | | | |
|---|---|---|---|---|---|
| 3,220,047 | A | * | 11/1965 | Flint | 16/62 |
| 4,073,033 | A | * | 2/1978 | Lexnas | 16/52 |
| 4,378,612 | A | * | 4/1983 | Beers | 16/62 |
| 4,641,406 | A | * | 2/1987 | Rogers | 29/893.3 |
| 4,744,125 | A | | 5/1988 | Scheck et al. | |
| 4,763,385 | A | * | 8/1988 | Furch et al. | 16/58 |
| 4,937,914 | A | | 7/1990 | Harrison et al. | |
| 5,850,671 | A | * | 12/1998 | Kaser | 16/79 |
| 5,943,736 | A | | 8/1999 | Kärkkäinen et al. | |

FOREIGN PATENT DOCUMENTS

| | | |
|---|---|---|
| FR | 966.945 | 5/1948 |

OTHER PUBLICATIONS

Guide to World Screw Threads, p. 212, Figure 12.

* cited by examiner

Schnitt A-A

OVERHEAD DOOR CLOSER WITH SLIDE ARM ASSEMBLY

PRIORITY CLAIM

This is a U.S. national stage of application No. PCT/EP02/01404, filed on 11 Feb. 2002. Priority is claimed on that application and on the following application: Country: Germany, Application No.: 101 07 046.2, Filed: 13 Feb. 2001.

BACKGROUND OF THE INVENTION

1. Field of the Invention

This invention relates to an overhead door closer with slide arm assembly, having a piston being guided in a housing and leaning against a closing spring, having a toothed pinion being eccentrically, rotatably supported at the housing, and meshing with a toothed rack of the piston, which pinion presents a circular rolling curve, the central point thereof being offset, in relation to the rotary axis of the pinion in the closing position, into the direction towards the toothed rack, and in relation to the rotary axis in the opening position, into the opposite direction.

2. Description of the Related Art

The above described overhead door closers with slide arm assembly, also known as rack and pinion door closers, with regard to traditional door closers, advantageously do not present an arm assembly protruding uncovered into the room, but they simply present an actuation arm sitting close and flat at the door frame or at the door leaf. They do, however, bear the disadvantage that the actuation arm, sitting close and flat at the door frame or at the door leaf, leads to an unfavourable course of forces at the door, in relation with conventional, symmetric rack and pinion mechanics. It is therefore an object to conceive an optimal rack and pinion drive, with the intention to achieve, during the opening procedure and closing procedure of the door, an operation of the pinion, as low in friction and smooth as possible, at the associated toothed rack and therefore of the piston inside the piston housing.

Centrically or eccentrically supported pinions are used in known door closers.

A door closer species, described at the beginning, having an eccentrically supported pinion is known from EP 0 856 628 A1, wherein the toothing of the toothed rack forms a linearly extending pitch line of engagement having an angle comprised between 4.5° and 7.2° with regard to the moving direction of the piston. The selection of an angle depends on the size of the door closer, respectively on the strength of the closing spring. Because of the eccentric support of the pinion and of the linear course of the toothed rack, an optimal, especially low friction and smooth progress of the pinion's teeth at the toothed rack is not guaranteed; there are spreads in the course of the momentums' curves.

A comparable solution applying a linearly extending toothed rack with an angle is described in U.S. Pat. No. 633,682.

Furthermore DE 36 45 313 C2 and DE 36 45 314 C2 reveal an eccentrically supported pinion where a rolling curve, arranged at the pinion, is used, having various lever arms in relation to the rotary axis. Accordingly, the rolling curve of the associated toothed rack extends in an arcuate form.

In a door closer known from DE 82 17 72 C2 respectively from the French Patent Application 96 69 45, the closer shaft is connected at an eccentrically supported elliptical toothed wheel meshing with an inclined toothed rack on the piston side. Up to a certain degree, a transmission, adapted to a desired course of the momentum, is achieved by means of the elliptical gear due to the differently long lever arms of the elliptical toothed wheel.

The pneumatic door closer according to U.S. Pat. No. 1,359,144 presents a circular eccentrically supported pinion which meshes with an uneven toothed rack at the piston. The circular pinion is provided with a regular toothing on a circular rolling curve, whereby varying lever arms come into effect due to the eccentrical support.

Various piston drive embodiments in door closers are described in DE 36 38 353 A1, in EP 0 207 251 A2, in DE 94 12 64 and in U.S. Pat. No. 2,933,755, whereby in relation with eccentrically or centrically supported pinions—if necessary with insertion of a transmitting gear drive—a direct charge of the closing spring is exerted by means of a crank drive.

Centrically supported pinions are known from EP 0 056 256 A2 as well as from EP 0 350 568 A2. EP 0 056 256 A2 deals with a door closer, the pistons thereof presenting two symmetrically, diametrically opposite toothed racks, whereby a centrically supported pinion engages, in the closing position, with shortened teeth, in both toothed racks of the piston.

The door closer according to EP 0 350 568 A2 presents a centrically supported pinion, which presents teeth extending at the circumference, with progressively increasing depths of teeth, which teeth engage between the rods of a correspondingly curve-shaped extending toothed rack.

A substantially centrically supported pinion of a drive for a door or for a window is disclosed in DE 44 44 131 A1 and DE 44 44 133 B1, wherein the pinion itself presents a toothing over up to approximately half the circumference thereof, the teeth thereof being disposed at lever arms varying in length and progressing on a correspondingly curved rolling curve of a toothed rack.

SUMMARY OF THE INVENTION

The object of the invention is to optimize, within the door closer housing, the progression of movements of the piston of the overhead door closer with slide arm assembly during the opening procedure and the closing procedure, i.e. to guarantee especially a jam-free and therefore low friction progression of the pinion at the toothed rack of the piston. By using a pinion having an appropriate rolling curve, the pinion's cost of production should be minimized, whereby, compared to known toothed racks, a particular embodiment of the toothed rack, due to the intended low friction to be achieved, should result in a longer lasting working life and in higher efficiency, which in return allows for using a weaker closing spring. In execution of the invention an improvement of the closing characteristics of the overhead door closer with slide arm assembly should be achieved additionally through an improved oil exchange from the piston chamber to the spring chamber during the closing procedure.

The invention solves the given problem with the teaching according to the claims 1, 3, and 4.

According to the invention, a toothed rack, respectively the teeth thereof are adapted in an optimal way to the progression of a toothing of a pinion, while taking into account its eccentrical support and its circular rolling curve, such that a smooth transition to each following adjacent tooth is guaranteed, during the opening procedure as well as during the closing procedure. This applies particularly to the portion of the pinion exceeding the rotation of 180°. In this case, it has proven to be advantageous that the opening-sided teeth's flank angle of the toothed rack be executed substantially in ascending manner up to approximately half the length of the toothed rack, and subsequently they be executed substantially in a constant or descending manner, whereby the descending course contributes to improving the low friction.

The rotation of the pinion, from the closing position up to the maximum opening position, may comprise more or less than approximately 180°, without having any negative influence on the required effectiveness. It is essential that the closing-sided tooth profiles of the last teeth of the toothed rack in the opening direction, arranged in the portion adjoining the 180°, be executed with an angle or rounded.

Further characteristics of the invention are characterized by the sub-claims.

In execution of the invention basically optional tooth forms may be used; i.e. the pinion and/or the toothed rack may present teeth with straight, angled or convex curved tooth profiles. However, it has proven to be advantageous—especially for reasons regarding production techniques—to attribute substantially a spur toothing to the toothed rack and an involute toothing to the pinion.

The invention includes furthermore an improvement of the closing characteristics through the improved oil exchange. Accordingly, the closing procedure comprises four closing phases, each closing phase, while including a certain tolerance, being associated in an already known manner to one closing angle. The first closing phase, as well as the third one, may be controlled through a single valve by means of the longitudinal groove that is arranged in the skirt of the piston such that the low friction course of the pinion at the toothed rack, attainable with the characteristics a) to d), is assisted by an advantageous embodiment of the oil exchange between the piston chamber and the spring chamber during the closing procedure, whereby it is not necessary to use a commonly required valve for the third closing phase.

BRIEF DESCRIPTION OF THE DRAWINGS

The invention will be explained in detail on the basis of a diagrammatically represented possible embodiment example, in which

According to FIGS. 1 to 6, a closing spring 3 acts on a piston 4 which is guided in a housing 2 of an overhead door closer with slide arm assembly 1. As illustrated in FIGS. 2 and 3, the piston 4 has a toothed rack 5 meshing with a pinion 6, which presents an involute toothing 7. In the region of the center longitudinal axis referenced to with numeral 23, the pinion 6 is eccentrically supported in the rotary axis referenced to with D, whereby in the closing position of pinion 6, illustrated in FIG. 3, a central point M of the rolling circle of pinion 6 is offset into the direction towards the toothed rack 5, and in the opening position, illustrated in FIG. 3, the central point M of the rolling circle of pinion 6 is offset into the opposite direction. The rolling curve of pinion 6, as can be seen, is circular. The teeth of toothed rack 5, generally referenced to with numeral 9, present opening-sided tooth profiles and closing-sided tooth profiles, whereby the closing-sided tooth profiles 8 (see FIG. 3) of the last two teeth 9 are executed with an angle. The tooth profiles of all the other teeth 9 present a straight course. The afore-mentioned measure guarantees that during a movement of piston 4 in the direction of arrow X (opening direction) when the pinion 6 progresses on the toothed rack 5, even in the region, in which the pinion 6 has slightly exceeded the rotation about 180° (see closing position of the pinion 6 in FIG. 3), a low friction mating of the involute toothing 7 with the teeth 9 of toothed rack 5 is realised. By the way, the rolling curve of the toothed rack 5 is adapted to the eccentrical support of pinion 6 and presents a correspondingly slightly S-shaped course, whereby all teeth 9 of the toothed rack 5 present different flank angles on the opening-side and on the closing-side, as can be seen in FIGS. 4 to 6, illustrating the pinion's progression at the toothed rack in three phases.

Respectively separated positions of pinion 6 are illustrated in the FIGS. 4 to 6. In this case, FIG. 4 illustrates the closing position, i.e. when the door is closed, namely the position of the piston 4 and of the pinion 6. In this case, the pinion 6 is located in the right zone of the aperture of piston 4. In this case, the rotary axis D is located on the center longitudinal axis 23. If the piston 4 is moved into the opening direction (direction of arrow X), the pinion 6 will rotate about the rotary axis D. Due to the eccentricity of pinion 6, a position arranged almost in a central region can be seen in FIG. 5, position that corresponds to a certain opening position of the door. Through the progression of pinion 6 at the toothed rack 5, the piston 4 has moved further into the opening direction.

Figure 1:
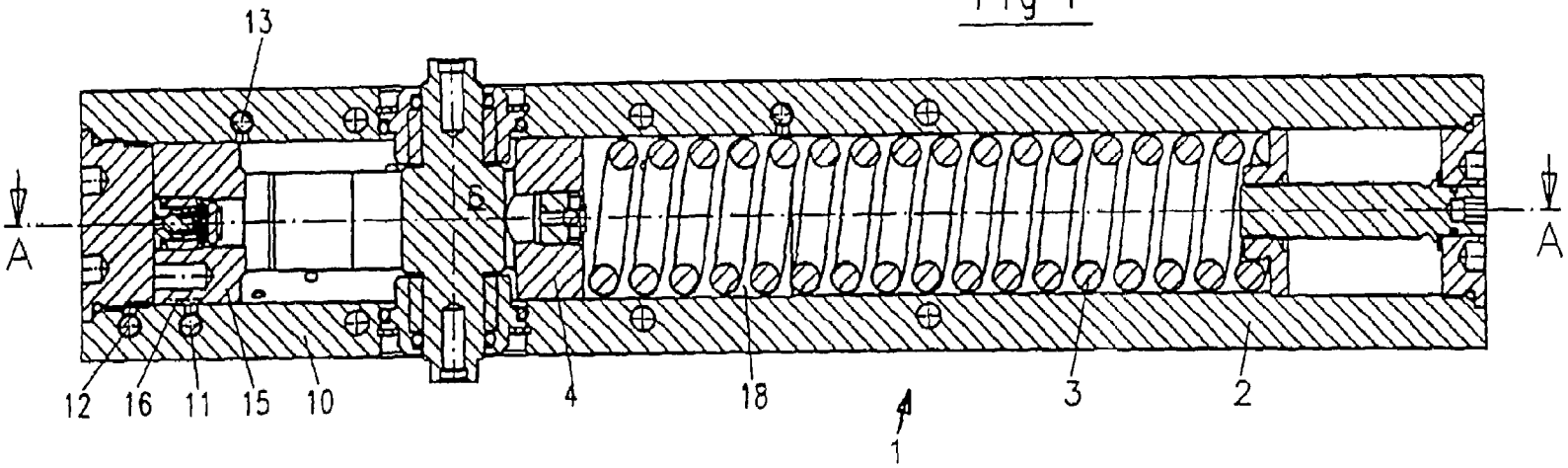
FIG. 1 shows a vertical section through a door closer housing.
Figure 2:
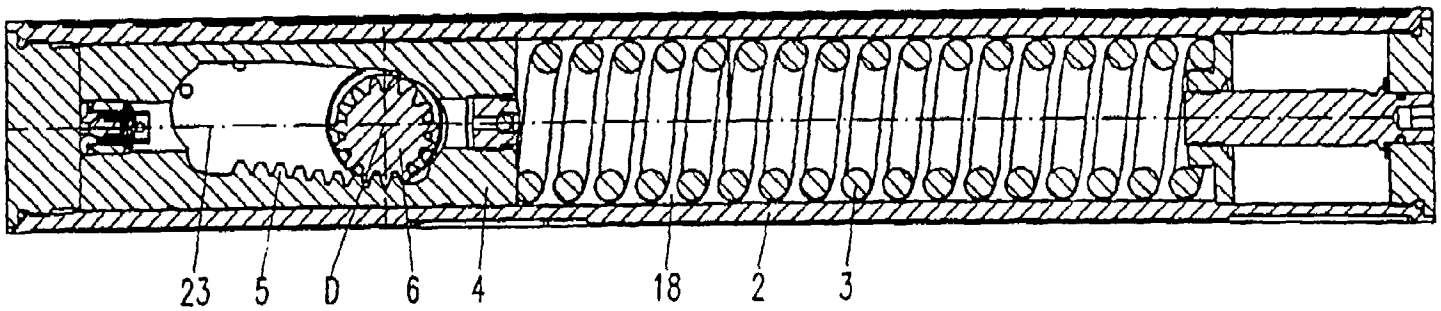
FIG. 2 shows a section following line A—A according to FIG. 1.
Figure 3:
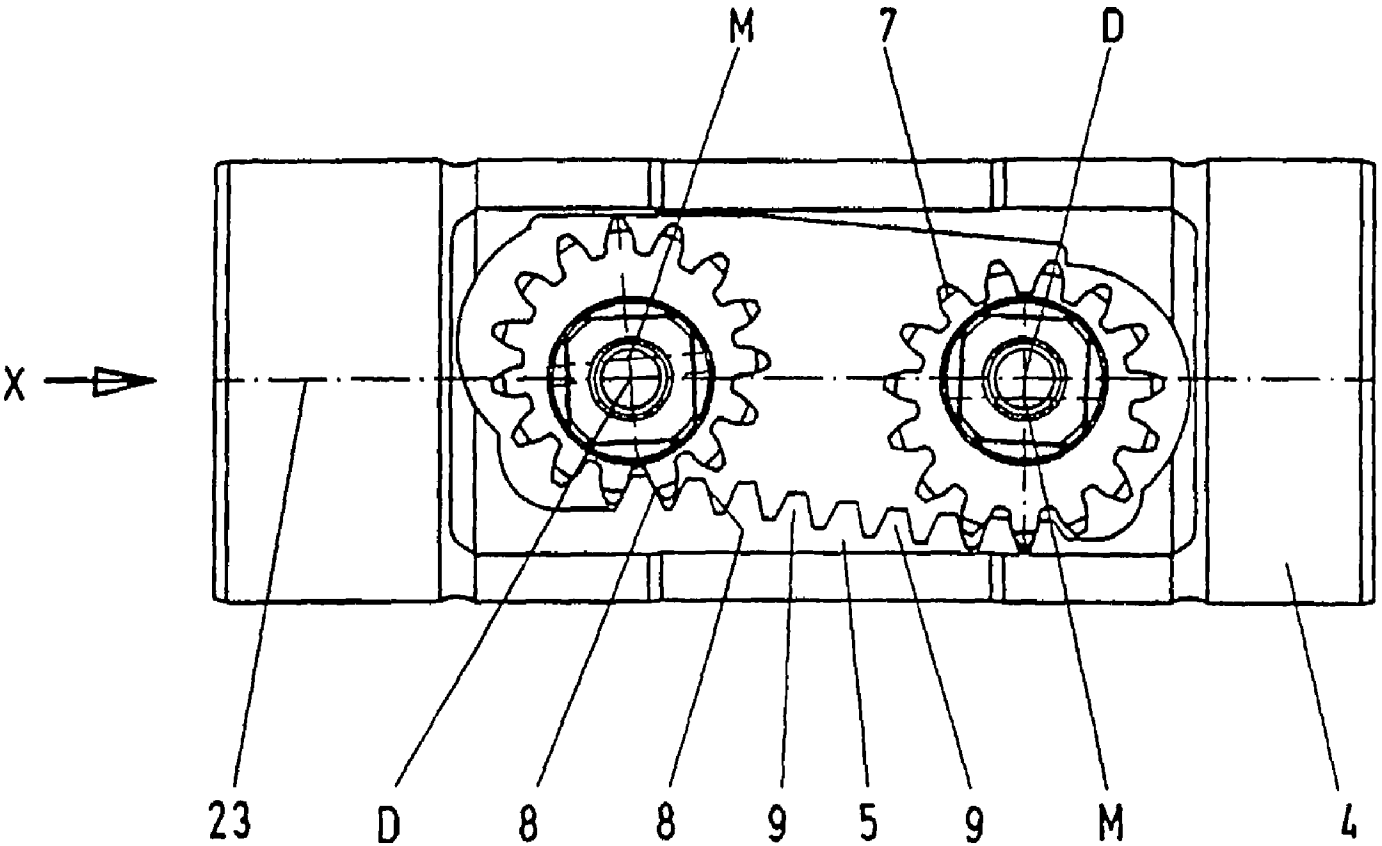
FIG. 3 shows a plane view on the piston including two end positions of the pinion.
Figure 4:
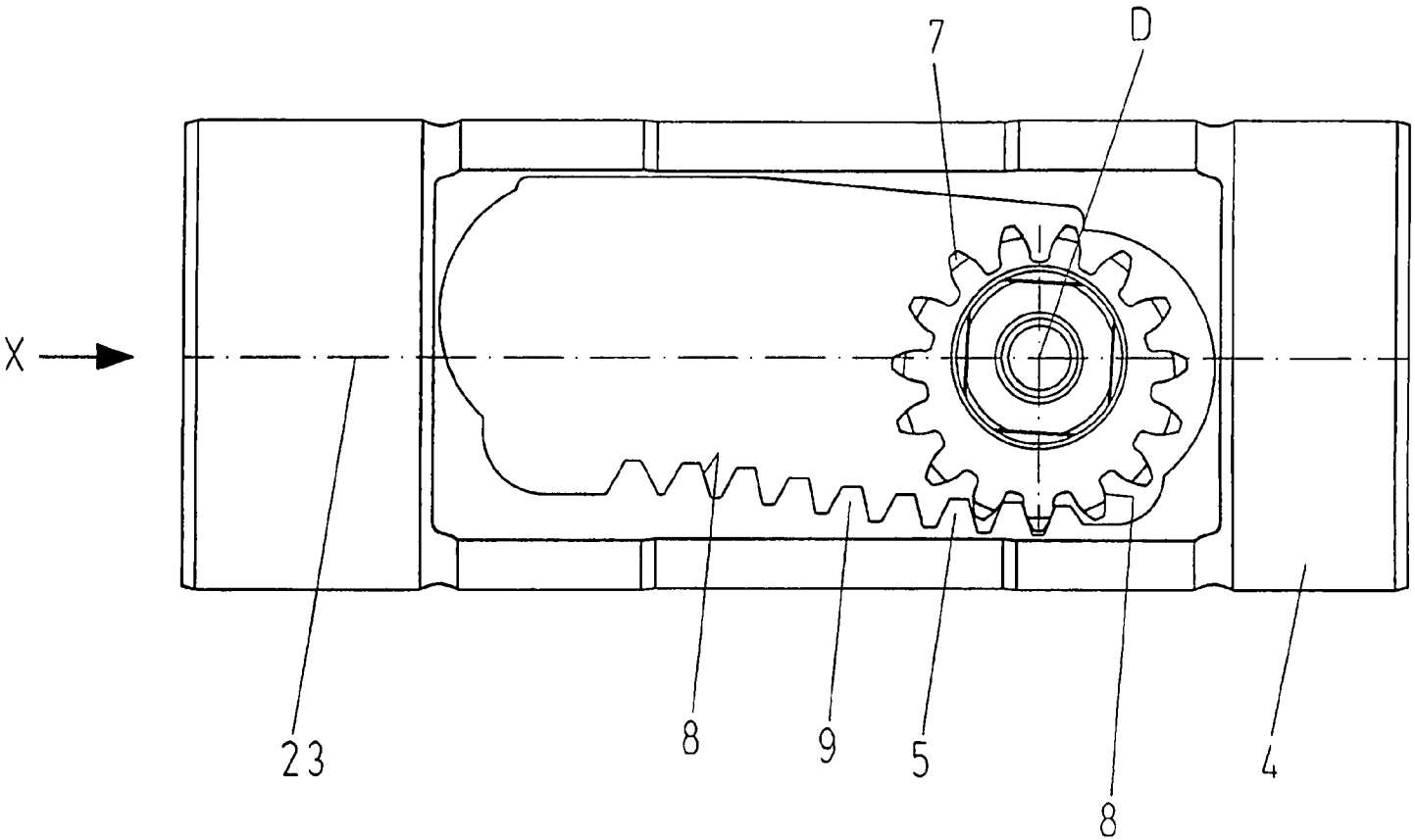
FIGS. 4 to 6 show three phases of the pinion's course at a toothed rack.
Figure 5:
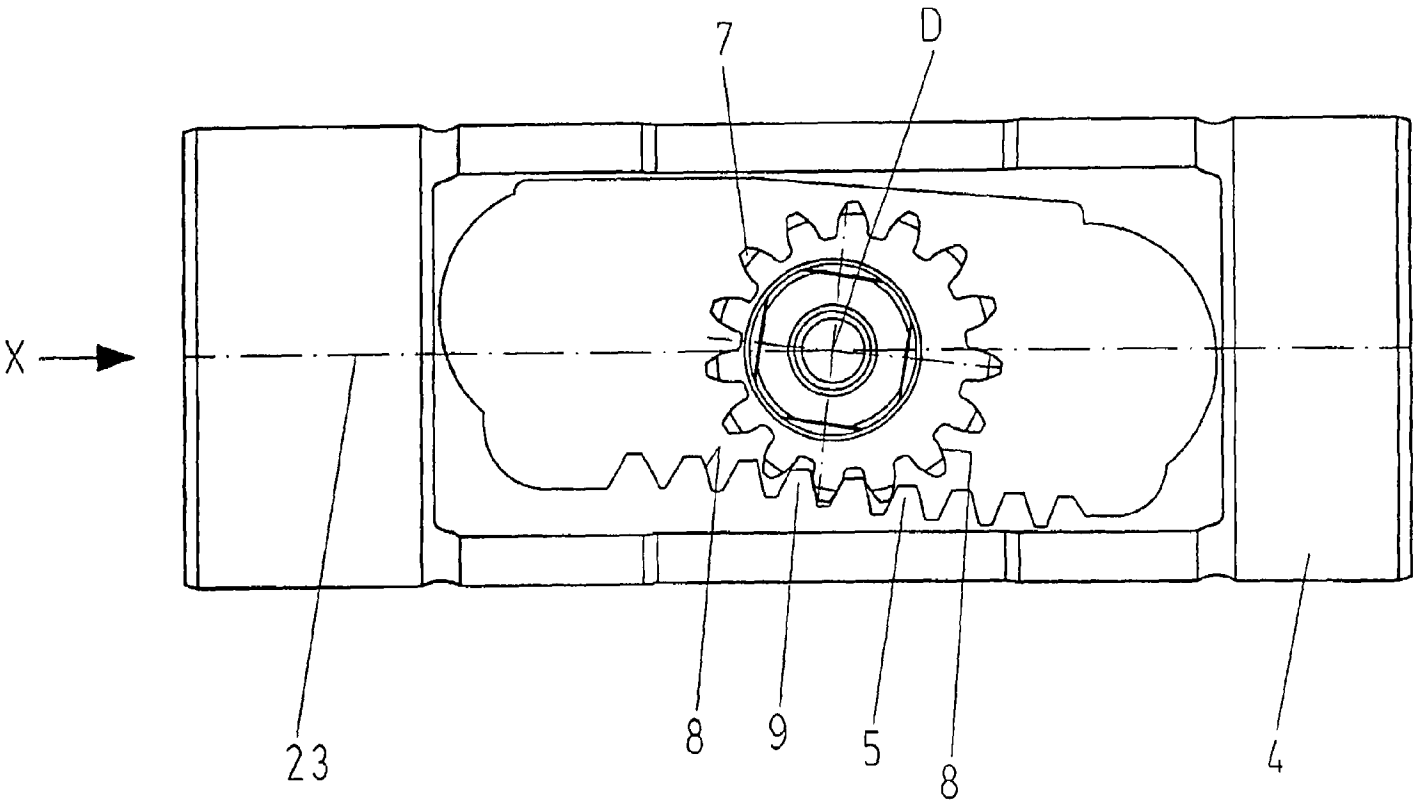
Figure 6:
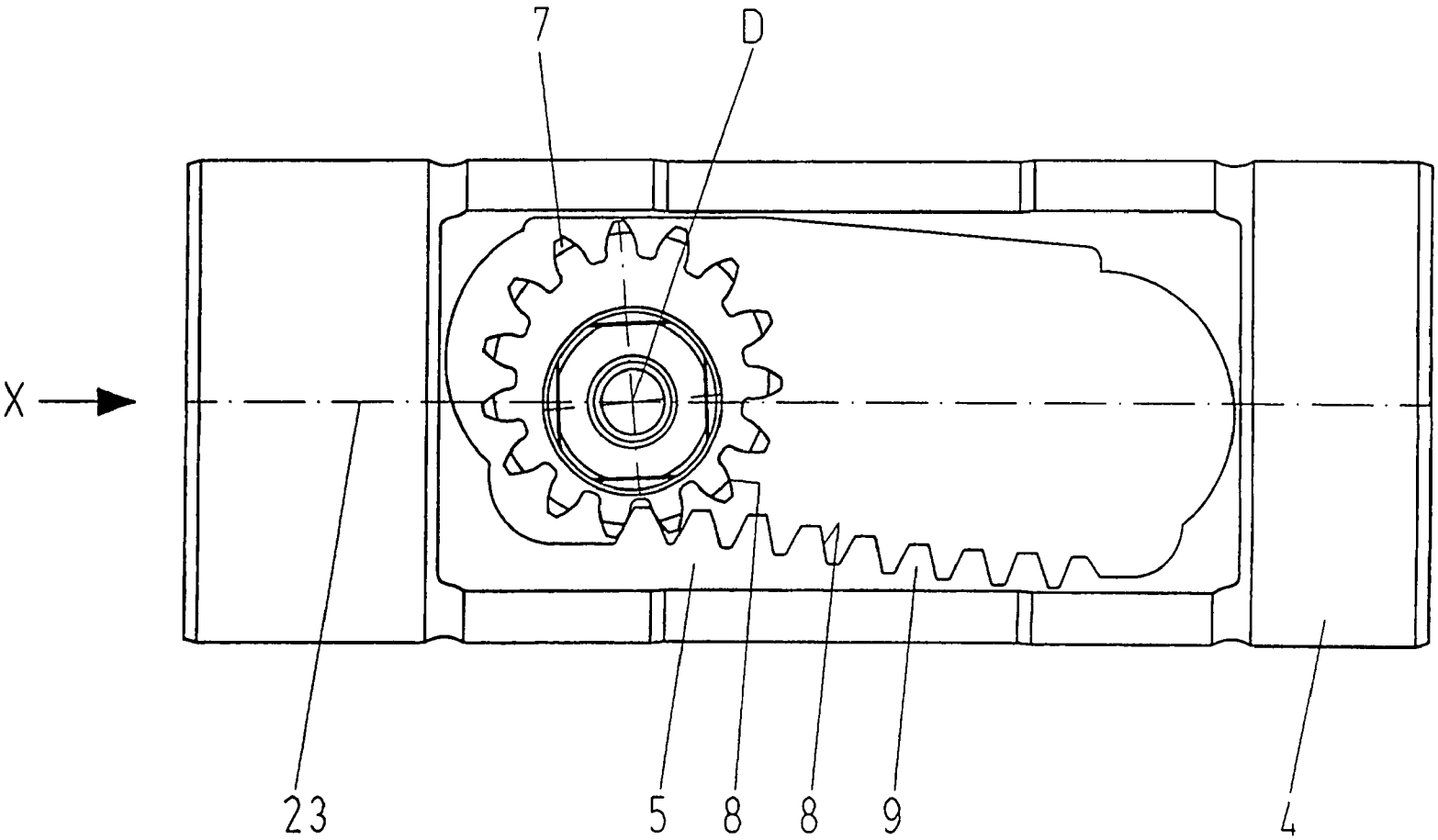

As especially shown in FIG. 1 and in FIGS. 7 to 10, three control valves 11, 12, and 13, serving the delayed closing operation, are disposed in the housing walls 10 of the overhead door closer with slide arm assembly 1, and functions thereof will be explained hereinafter on the basis of FIGS. 7 to 10.

Figure 7:
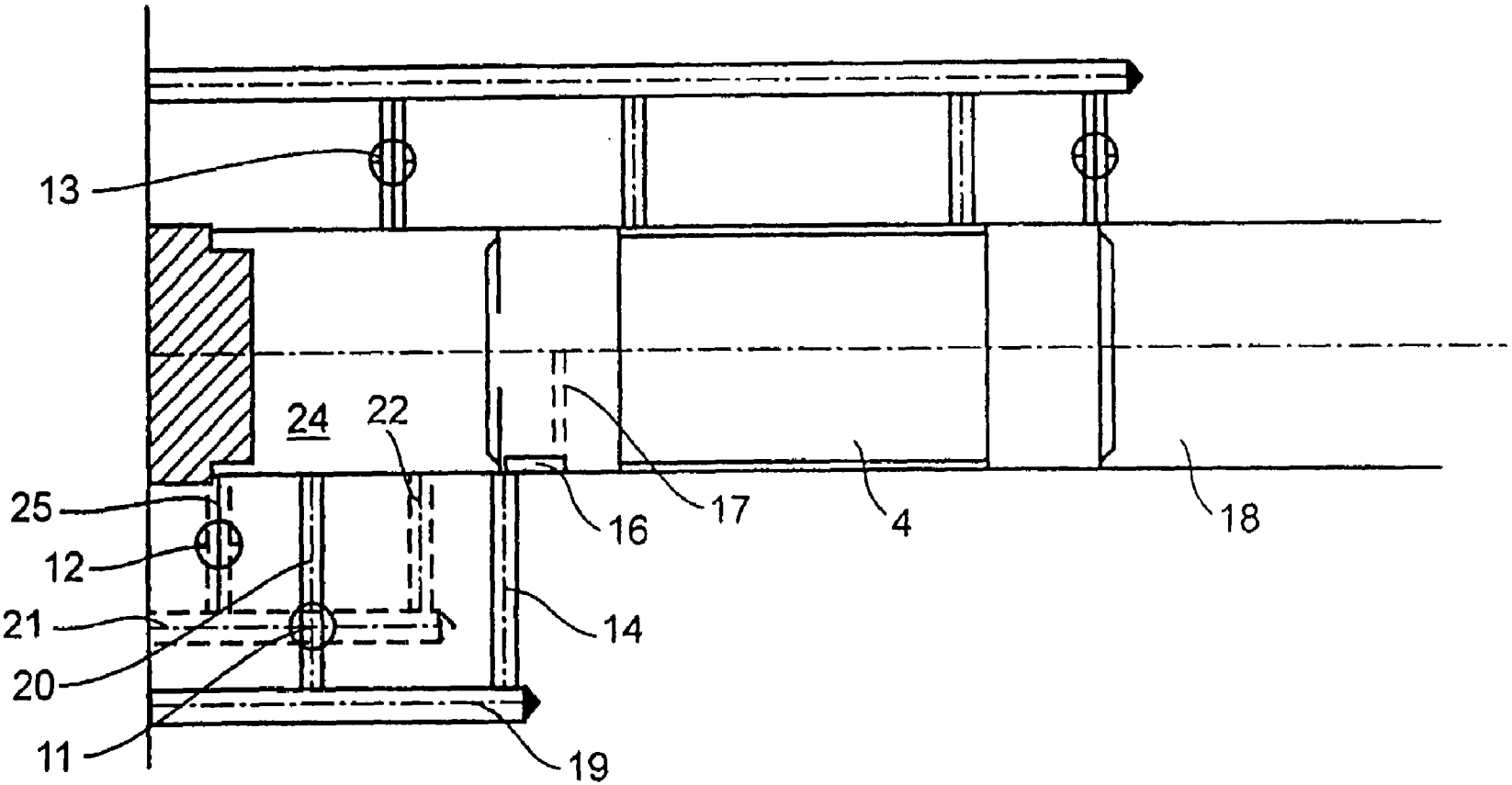
FIGS. 7 to 10 show in a diagrammatical illustration, four positions of the piston during the delayed closing operation.

During the start of the closing procedure according to FIG. 7, the piston 4 passes an oil outlet duct 14, which, via a duct 19, is connected with a control valve 1 and via a duct 20 with a piston chamber 24. The oil exiting the piston chamber 24, via a longitudinal groove 16 in the skirt 15 of the piston 4 and a radial borehole 17 in the piston 4, can pass over into the spring chamber 18. The ducts 25, 21, and 22, associated to the control valve 12, are arranged in another plane.

Figure 8:
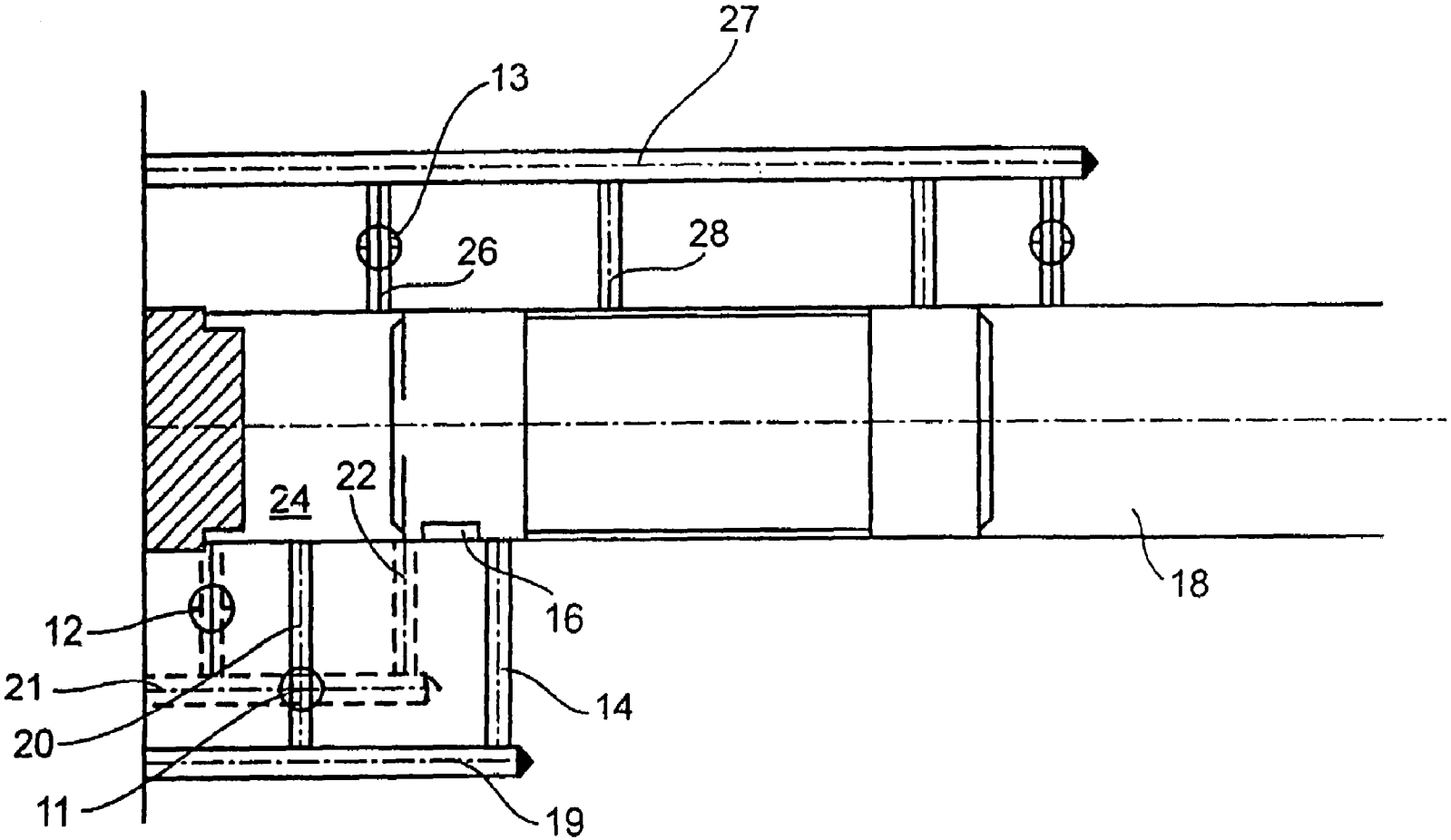
Figure 9:
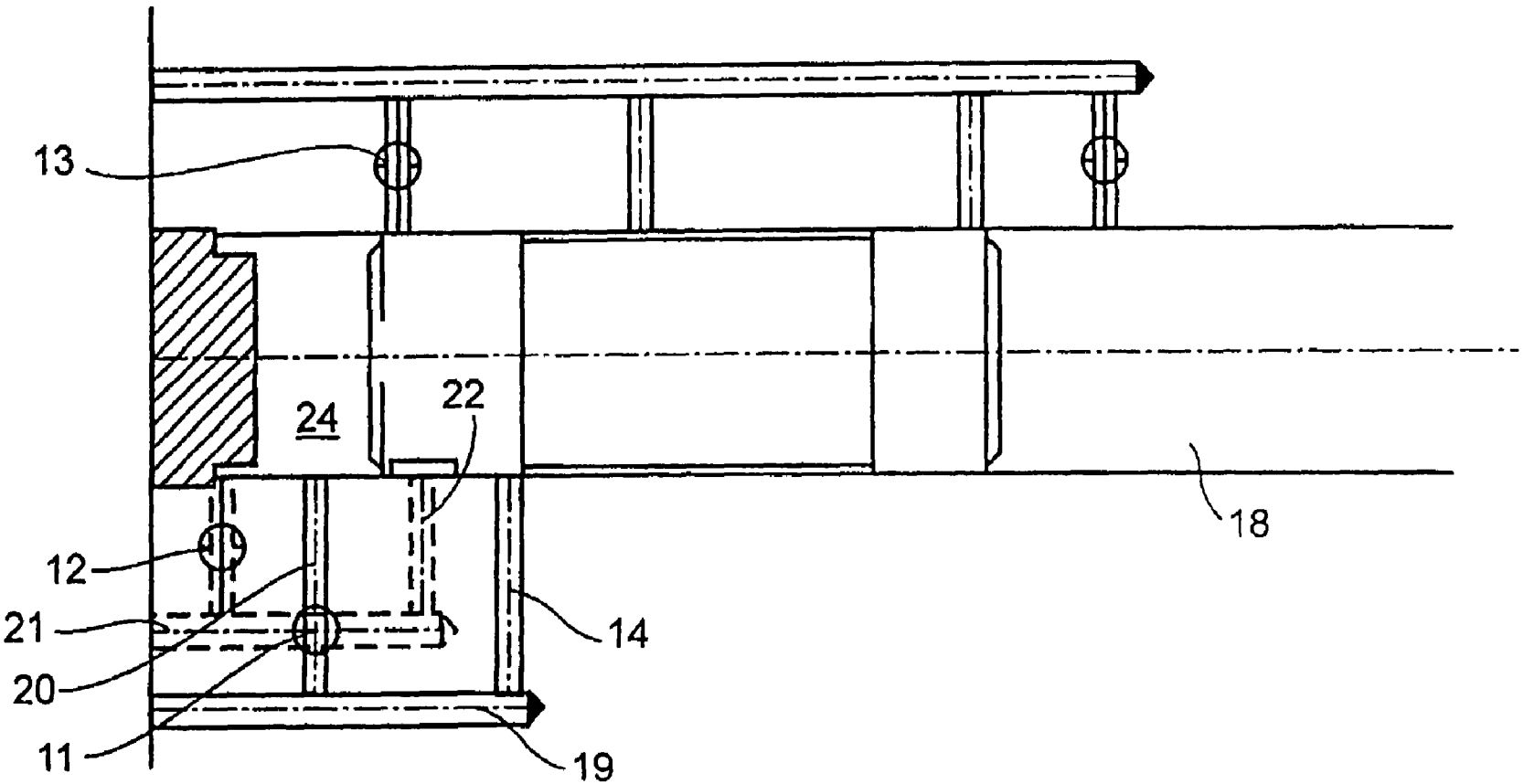
Figure 10:
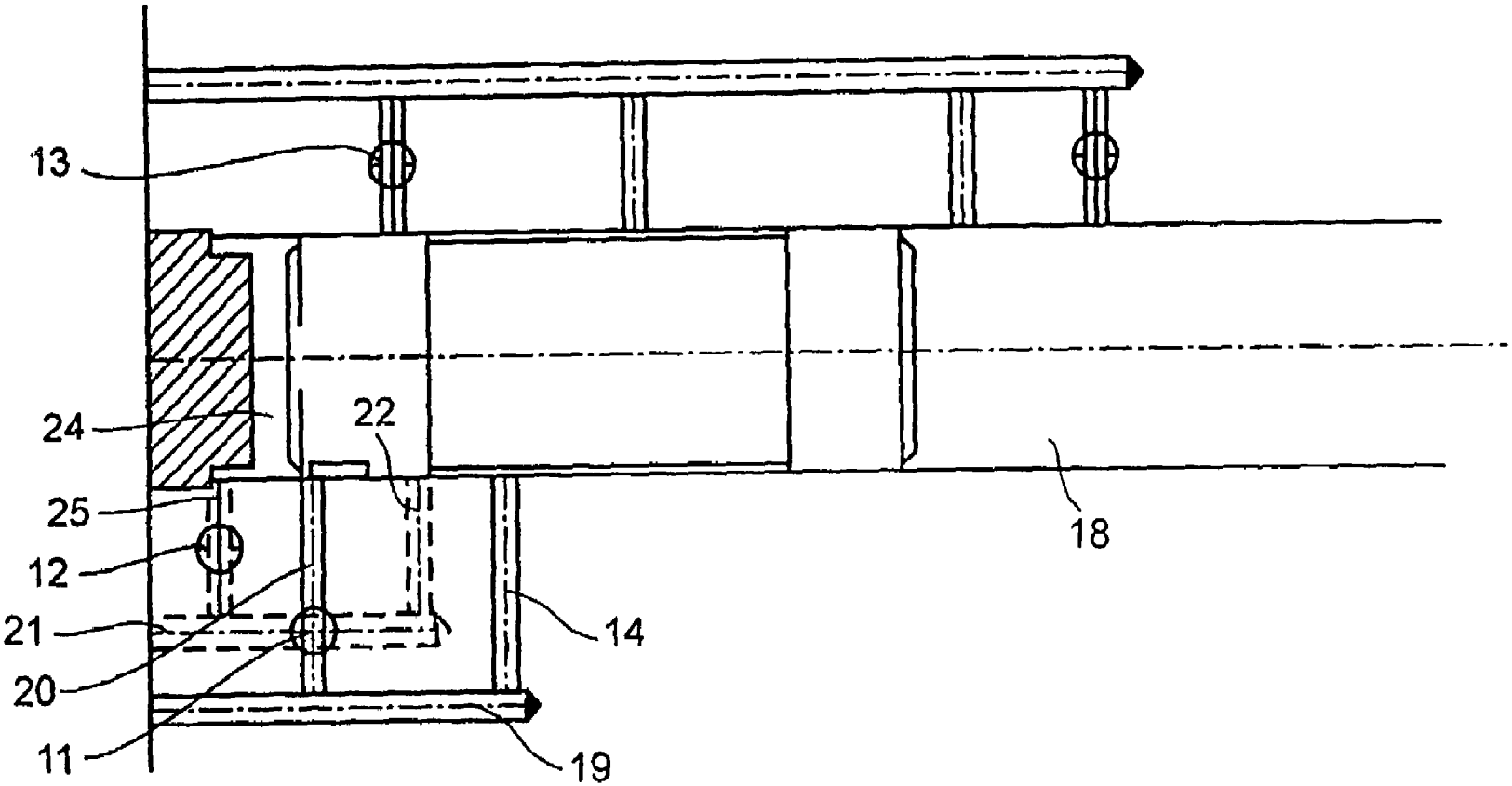

According to FIG. 8, the longitudinal groove 16 passed the duct 14, such that an oil transfer, from the piston chamber 24 to the spring chamber 18, is only possible due to the play between the piston 5 and the wall of the housing 10, resulting in a strong delay of the closing speed (second phase of the delayed closing operation).

During the third phase of the delayed closing operation, the oil passes again from the piston chamber 24, via the duct 20 and the same control valve 11 as well as the ducts 19 and 14 into the region of a not specifically illustrated overflow edge of piston 4, into the spring chamber 18. As the same control valve 11 is involved, the closing speed is identical in the first and in the third delaying phase.

During the fourth phase of the delayed closing operation (beginning of the closing region) the duct 20 of the valve 11 leading to the piston chamber 24 is closed; in this case the oil coming from the piston chamber 24 passes, via the duct 25, the control valve 12, the duct 21, and the duct 22 via the afore mentioned overflow edge, into the spring chamber 18. The control valve, referenced to with the numeral 13, is normally closed during the delayed closing operation; there is, however, the possibility of reducing the delaying period, through corresponding opening of this valve during the second closing phase (during which an oil exchange happens only through leakage between the piston and the housing walls), whereby the oil exiting the piston chamber 24 is conducted, while being reduced, via the duct 26, the control valve 13, the duct 27, and the duct 28, into the spring chamber 18.

Figure 11:
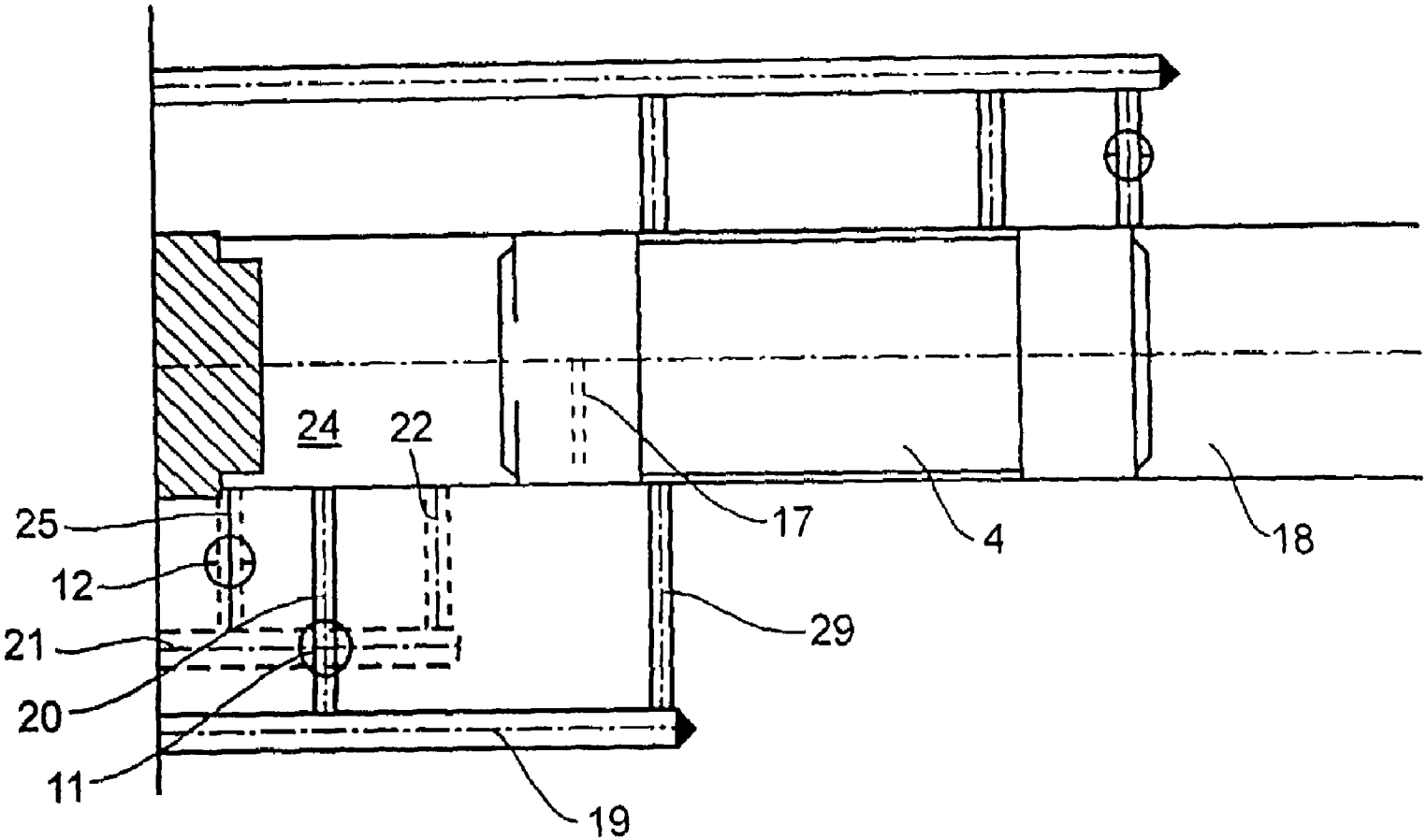
FIG. 11 shows a second embodiment of the delayed closing operation.

An alternative embodiment with regard to the execution of the oil outlet ducts and the valves for controlling the closing procedure is illustrated in FIG. 11. In this alternative embodiment only two different closing phases are realised, such that a modification with regard to the above described four closing phases is possible. Therefore, only the valves 11 and 12 are required. The oil outlet duct 19 is extended and leads into an oil outlet duct 29 ending behind the not specifically designated overflow edge of piston 4 in the region of the toothed rack 5.

Besides the above described two embodiment examples with regard to different closing phases of the connected doors, it is of course possible, within the scope of the invention, to realise a different number of closing phases having various closing speeds.

REFERENCES

| | |
|---|---|
| 1 | overhead door closer with slide arm assembly |
| 2 | housing |
| 3 | closing spring |
| 4 | piston |
| 5 | toothed rack |
| 6 | pinion |
| 7 | involute toothing |
| 8 | closing-sided tooth profiles |
| 9 | teeth of the toothed rack |
| 10 | housing walls |
| 11 | control valve |
| 12 | control valve |
| 13 | control valve |
| 14 | oil outletduct |
| 15 | skirt of the piston |
| 16 | longitudinal groove |
| 17 | radial bore hole |
| 18 | spring chamber |
| 19 | oil outlet duct |
| 20 | oil outlet duct |
| 21 | oil outlet duct |
| 22 | oil outlet duct |
| 23 | center longitudinal axis |
| 24 | piston chamber |
| 25 | oil outlet duct |
| 26 | oil outlet duct |
| 27 | oil outlet duct |
| 28 | oil outlet duct |
| 29 | oil outlet duct |
| M | central point of the pinion's rolling circle |
| D | rotary axis of the pinion |
| X | direction of the arrow in the opening direction |

The invention claimed is:

1. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the teeth having respective tooth heads with a width which increases up to approximately half the length of the toothed rack and subsequently decreases;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack; and a control valve arrangement which reduces the closing speed of the piston as the piston moves toward said closing position, said control valve arrangement comprising a first control valve and a second control valve, said piston being moved in said closing direction in four phases comprising:

a first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

2. The overhead door closer of claim 1, wherein the teeth of said toothed rack have a straight tooth profile.

3. The overhead door closer of claim 1, wherein said pinion has teeth with an involute profile.

4. The overhead door closer of claim 1, wherein said housing comprises a housing wall in which said control valve arrangement is located, said control valve arrangement comprising at least one control valve associated with two of said closing phases.

5. The overhead door closer of claim 1, wherein said housing comprises a spring chamber in the opening direction and a piston chamber in the closing direction, said piston separating spring chamber from said piston chamber, said piston has a skirt with a longitudinal groove which communicates with said spring chamber via a radial bore hole in the piston, and said control valve arrangement comprising a first control valve in a first oil outlet duct which leads into said groove during said first phase of said delayed closing operation.

6. The overhead door closer of claim 5, wherein said first oil outlet duct communicates with said piston chamber via said first control valve.

7. The overhead door closer of claim 6, wherein said piston exhibits play with respect to said housing wall, said play enabling a pressure compensation between said piston chamber and said spring chamber during the second phase of the delayed closing operation.

8. The overhead door closer of claim 6, wherein said piston has an overflow edge, said first oil outlet duct communicating between said piston chamber and said spring chamber via said first oil outlet duct and said overflow edge of said piston during said third closing phase.

9. The overhead door closer of claim 8, wherein said first oil outlet duct is closed during said fourth closing phase, said control valve arrangement further comprising a second control valve in a second oil outlet duct, said piston chamber communicating with said spring chamber via said second oil outlet duct and said overflow edge during said fourth closing phase.

10. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant, the closing side flank angle of the teeth decreasing up to approximately half the length of the toothed rack and subsequently increasing, the closing side tooth profile of the last teeth in the opening direction being executed with an increased flank angle;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through less than 180 degrees from the closing position to the opening position; and a control valve arrangement reducing the closing speed of the piston as the piston moves toward said closing position, said control valve arrangement comprising a first control valve and a second control valve, said piston being moved in said closing direction in four phases comprising:

a first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

11. An The overhead door closer of claim 10, wherein the teeth of said toothed rack have a straight profile.

12. The overhead door closer of claim 10, wherein said pinion has teeth with an involute profile.

13. The overhead door closer of claim 10, wherein said housing comprises a housing wall in which said control valve arrangement is located, said control valve arrangement comprising at least one control valve associated with two of said closing phases.

14. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant, the closing side flank angle of the teeth decreasing up to approximately half the length of the toothed rack and subsequently increasing, the closing side tooth profile of the last teeth in the opening direction being executed with an increased flank angle;

said housing comprising a spring chamber in the opening direction and a piston chamber in the closing direction, said piston separating said spring chamber from said piston chamber, a spring urging said piston in the closing direction, said piston having a skirt with a longitudinal groove which communicates with said spring chamber via a radial bore hole in the piston;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through less than 180 degrees from the closing position to the opening position; and a control valve arrangement reducing the closing speed of the piston as the piston moves toward said closing position and comprising a first control valve in a first oil outlet duct which leads into said groove during a first phase of said delayed closing operation, wherein said first oil outlet duct communicates with said piston chamber via said first control valve; said piston having an overflow edge, said first oil outlet duct communicating between said piston chamber and said spring chamber via said first oil outlet duct and said overflow edge of said piston during at least one additional closing phase subsequent to said first phase.

15. The overhead door closer of claim 14, wherein said piston exhibits play with respect to said housing wall, said play enabling a pressure compensation between said piston chamber and said spring chamber during a second phase of the delayed closing operation occurring between the first and at least one additional phases.

16. An overhead door closer with a slide arm assembly, said slide arm assembly comprising:

a housing, comprising a spring chamber in an opening direction and a piston chamber in a closing direction;

a piston guided in said housing between a closing position and an opening position along a center longitudinal axis so as to separate said spring chamber from said piston chamber, said piston moving in said closing direction toward said closing position and in said opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the opening side flank angle of the teeth increasing up to approximately half the length of the toothed rack and subsequently being substantially constant, the closing side flank angle of the teeth decreasing up to approximately half the length of the toothed rack and subsequently increasing, the closing side tooth profile of the last teeth in the opening direction being executed with an increased flank angle;

a skirt provided in said piston and configured with a longitudinal groove which communicates with said spring chamber via a radial bore hole in the piston, a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through less than 180 degrees from the closing position to the opening position; and a control valve arrangement operative to reduce the closing speed of the piston as the piston moves toward said closing position and comprising a first control valve in a first oil outlet duct which leads into said groove during a first phase of said delayed closing operation, said first oil outlet duct communicating with said piston chamber via said first control valve, said delayed closing operation further comprising an additional closing phase of said delayed closing operation, said piston having an overflow edge, said first oil outlet duct communicating between said piston chamber and said spring chamber via said first oil outlet duct and said overflow edge of said piston during said additional closing phase;

said first oil outlet duct being closed during a final closing phase of said delayed closing operation, said control valve arrangement further comprising a second control valve in a second oil outlet duct, said piston chamber communicating with said spring chamber via said second oil outlet duct and said overflow edge during said final closing phase.

17. An overhead door closer with a slide arm assembly, said slide arm assembly comprising:

a housing having a piston chamber and a spring chamber;

a piston guided in said housing along a center longitudinal axis between a closing position in the piston chamber and an opening position in the spring chamber, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the teeth having respective tooth heads with a width which increases up to approximately half the length of the toothed rack and subsequently decreases, said piston having a skirt with a longitudinal groove which communicates with said spring chamber via a radial bore hole in the piston;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack; and a control valve arrangement which reduces the closing speed of the piston as the piston moves toward said closing position in a delayed closing operation, said control valve arrangement comprising a first control valve in a first oil outlet duct which leads into said groove during a first phase of said delayed closing operation, said first oil outlet duct communicating with said piston chamber via said first control valve;

wherein said piston exhibits play with respect to said housing wall, said play enabling a pressure compensation between said piston chamber and said spring chamber during a second phase of the delayed closing operation; and wherein said closing operation comprises a third closing phase, said piston having an overflow edge, said first oil outlet duct communicating between said piston chamber and said spring chamber via said first oil outlet duct and said overflow edge of said piston during said third closing phase.

18. The overhead door closer of claim 17, wherein the teeth of said toothed rack have a straight tooth profile.

19. The overhead door closer of claim 17, wherein said pinion has teeth with an involute profile.

20. The overhead door closer of claim 17, wherein said housing comprises a housing wall in which said control valve arrangement is located, said control valve arrangement comprising at least one control valve associated with two of said closing phases.

21. The overhead door closer of claim 17, wherein said closing operation comprises a fourth closing phase, said first oil outlet duct being closed during said fourth closing phase, said control valve arrangement further comprising a second control valve in a second oil outlet duct, said piston chamber communicating with said spring chamber via said second oil outlet duct and said overflow edge during said fourth closing phase.

22. The overhead door closer of claim 21, wherein said first closing phase runs between approximately 180 degrees and 100 degrees, wherein said piston moves with a constant closing speed controlled by said first control valve;

said second closing phase runs between approximately 100 degrees and 70 degrees, wherein the functioning of said first and second control valves is cancelled;

said third closing phase runs between approximately 70 degrees and 20 degrees, wherein said piston moves with said constant closing speed controlled by said first control valve; and said fourth closing phase runs between approximately 20 degrees and zero degrees, controlled by said second control valve.

23. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the teeth having respective tooth heads with a width which increases up to approximately half the length of the toothed rack and subsequently decreases, wherein the opening side flank angle of the teeth increases up to approximately half the length of the toothed rack and is subsequently substantially constant, and the closing side flank angle of the teeth decreases up to approximately half the length of the rack and subsequently increases, the closing side tooth profile of the last teeth in the opening direction having an increased flank angle;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack; and a control valve arrangement which reduces the closing speed of the piston as the piston moves toward said closing position in a delayed closing operation, said control valve arrangement comprises a first control valve and a second control valve, said piston being moved in said closing direction in four phases comprising:

a first closing phase between approximately 180 degrees and 100 degrees wherein said piston moves with a constant closing speed controlled by said first control valve;

a second closing phase between approximately 100 degrees and 70 degrees wherein the functioning of said first and second control valves is cancelled;

a third closing phase between approximately 70 degrees and 20 degrees wherein said piston moves with said constant closing speed controlled by said first control valve; and a fourth closing phase between approximately 20 degrees and zero degrees controlled by said second control valve.

24. The overhead door closer of claim 23, wherein the teeth of said toothed rack have a straight tooth profile.

25. The overhead door closer of claim 23, wherein said pinion has teeth with an involute profile.

26. The overhead door closer of claim 23, wherein said housing comprises a housing wall in which said control valve arrangement is located, said control valve arrangement comprising at least one control valve associated with two of said closing phases.

27. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the teeth having respective tooth heads with a width which increases up to approximately half the length of the toothed rack and subsequently decreases, wherein the opening side flank angle of the teeth increases up to approximately half the length of the toothed rack and is subsequently substantially constant, and the closing side flank angle of the teeth decreases up to approximately half the length of the rack and subsequently increases, the closing side tooth profile of the last teeth in the opening direction having an increased flank angle;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack; and a control valve arrangement which reduces the closing speed of the piston as the piston moves toward said closing position in a delayed closing operation said housing comprises a spring chamber in the opening direction and a piston chamber in the closing direction, said piston separating spring chamber from said piston chamber, said piston has a skirt with a longitudinal groove which communicates with said spring chamber via a radial bore hole in the piston, and said control valve arrangement comprising a first control valve in a first oil outlet duct which leads into said groove during a first phase of said delayed closing operation, said piston exhibiting play with respect to said housing wall, said play enabling a pressure compensation between said piston chamber and said spring chamber during a second phase of the delayed closing operation, said closing operation comprising a third closing phase, said piston having an overflow edge, said first oil outlet duct communicating between said piston chamber and said spring chamber via said first oil outlet duct and said overflow edge of said piston during said third closing phase.

28. The overhead door closer of claim 27, wherein said first oil outlet duct communicating with said piston chamber via said first control valve.

29. An overhead door closer with a slide arm assembly, said slide arm assembly comprising:

a housing;

a piston guided in said housing between a closing position and an opening position along a center longitudinal axis, said piston moving in a closing direction toward said closing position and in an opening direction toward said opening position, said piston having a toothed rack having teeth arranged on an S-shaped rolling curve with a gradient which increases from the closing position up to approximately half the length of the rack and subsequently decreases, each said tooth having a closing side tooth profile and an opening side tooth profile having different flank angles, the teeth having respective tooth heads with a width which increases up to approximately half the length of the toothed rack and subsequently decreases, wherein the opening side flank angle of the teeth increases up to approximately half the length of the toothed rack and is subsequently substantially constant, and the closing side flank angle of the teeth decreases up to approximately half the length of the rack and subsequently increases, the closing side tooth profile of the last teeth in the opening direction having an increased flank angle;

a spring urging said piston in the closing direction;

a toothed pinion supported for rotation about a rotary axis in said housing and having teeth which mesh with the teeth of said rack, said pinion being eccentrically mounted and having a circular rolling curve with a center point which, in the closing position, is offset from the rotary axis toward the toothed rack and, in the opening position, is offset from the rotary axis away from the toothed rack, said pinion rotating through more than 180 degrees from the closing position to the opening position, said pinion having a portion exceeding said 180 degrees which engages said last teeth in the opening direction of said rack; and a control valve arrangement which reduces the closing speed of the piston as the piston moves toward said closing position in a delayed closing operation said housing comprises a spring chamber in the opening direction and a piston chamber in the closing direction, said piston separating spring chamber from said piston chamber, said piston has a skirt with a longitudinal groove which communicates with said spring chamber via a radial bore hole in the piston, and said control valve arrangement comprising a first control valve in a first oil outlet duct which leads into said groove during a first phase of said delayed closing operation, said piston exhibiting play with respect to said housing wall, said play enabling a pressure compensation between said piston chamber and said spring chamber during a second phase of the delayed closing operation, said closing operation further comprising a third closing phase, said piston having an overflow edge, said first oil outlet duct communicating between said piston chamber and said spring chamber via said first oil outlet duct and said overflow edge of said piston during said third closing phase, and a fourth closing phase, said first oil outlet duct being closed during said fourth closing phase, said control valve arrangement further comprising a second control valve in a second oil outlet duct, said piston chamber communicating with said spring chamber via said second oil outlet duct and said overflow edge during said fourth closing phase.

* * * * *